United States Patent [19]

Clark

[11] Patent Number: 4,787,779

[45] Date of Patent: Nov. 29, 1988

[54] METHOD AND APPARATUS FOR RAISING AND SUPPORTING A FOUNDATION

[76] Inventor: Howard E. Clark, 20402 78th Pl. West, Edmonds, Wash. 98020

[21] Appl. No.: 8,482

[22] Filed: Jan. 29, 1987

[51] Int. Cl.[4] ..... E02D 27/48

[52] U.S. Cl. ..... 405/230; 405/233

[58] Field of Search ..... 405/229, 230, 233, 288, 405/289

[56] References Cited

U.S. PATENT DOCUMENTS

| | | | |
|---|---|---|---|
| 2,378,995 | 6/1945 | Freeman . | |
| 3,269,126 | 8/1966 | Freeman, Jr. . | |
| 3,796,055 | 3/1974 | Mahony | 405/230 |
| 4,092,832 | 6/1978 | Mattson . | |
| 4,185,940 | 1/1980 | Spies | 405/288 |
| 4,338,047 | 7/1982 | Davis . | |
| 4,507,069 | 3/1985 | Murray et al. . | |
| 4,548,526 | 10/1985 | Bullivant | 405/230 X |
| 4,563,110 | 1/1986 | Langenbach, Jr. et al. . | |
| 4,567,708 | 2/1986 | Haekkinen . | |
| 4,591,466 | 5/1986 | Murray et al. . | |

FOREIGN PATENT DOCUMENTS

| | | | |
|---|---|---|---|
| 212189 | 4/1967 | Sweden | 405/230 |
| 325093 | 2/1930 | United Kingdom | 405/230 |

*Primary Examiner*—David H. Corbin

*Attorney, Agent, or Firm*—Christensen, O'Connor, Johnson & Kindness

[57] ABSTRACT

A method and apparatus for raising and supporting a foundation where a hole is excavated beneath the foundation, one or more pipes are driven into the earth at diverging angles to form a piling, and a jack is placed in the hole above the piling and beneath the foundation. A self-hardening fluid is forced into the jack to raise the foundation. A jack is created from a pair of hollow cylinders, each having a single closed end, and slidably engaged open end to open end for vertical movement when a self-hardening fluid is forced through an opening formed in one of the cylinders. The jack may be formed of an opened-top cylinder having a concrete piston formed inside that is raised by pumping grout through an opening in the cylinder and into a void under the piston.

12 Claims, 4 Drawing Sheets

METHOD AND APPARATUS FOR RAISING AND SUPPORTING A FOUNDATION

TECHNICAL FIELD

This invention relates generally to the raising of foundations that have settled, and more particularly to a method and apparatus for the raising and supporting of settled foundations.

BACKGROUND OF THE INVENTION

Foundations that have settled due to weak or unstable soil conditions must not only be raised back to their original level, but the underlying earth must be reinforced or stabilized to prevent furthter settling. A number of methods and devices have been proposed for remedying these problems.

Langenbach, Jr., et al., U.S. Pat. No. 4,563,110, teaches a shoring apparatus and method comprising a piling member that is lowered through a hole in the concrete floor. The piling member rotates about a vertical axis to bear down upon the earth and exert an upward force on the floor. Haekkinen, U.S. Pat. No. 4,567,708, discloses a method for raising a floor wherein a hole is made in the floor and then pressurized foam is sprayed between the floor and the underlying earth to create pressure to thereby raise the floor. A disadvantage of these and other similar methods is that they first require a hole to be drilled in the concrete slab. In many applications, this is not possible or would be extremely expensive. In addition, the device for raising and supporting the floor bears down on or rests upon the suken and unstable earth, thus creating the potential for additional settling of the floor or slab.

David, U.S. Pat. No. 4,338,047, teaches a system for pier underpining of a settling foundation. A pier of concrete and pipes is constructed directly beneath the foundation footing, a mechanical jack is then arranged immediately underneath the foundation footing and on top of the pier, and after the jack has raised the foundation footing, additional concrete is poured beneath the foundation footing to encapsulate the mechanical jack. Freeman, U.S. Pat. No. 3,269,126, discloses a method for stabilizing and raising foundation structures that involves excavating a hole beneath the foundation wall, placing a pipe having a conical end flange and an intermediate barrier flange in the hole, the filling the hole with concrete. After the concrete has set, a plastic, hard-setting composition is pumped through the pipe to force the concrete and the abutting foundation upwards. A disadvantage of these and other similar methods is the cost of leaving expensive jacks and other equipment in the ground. A further disadvantage is the cost of excavating a deep cavity beneath the foundation. Another drawback of the latter method is that the hard-setting composition will seep into the ground as it dries, thus allowing the foundation to resettle.

Another method requires a large hole to be dug underneath the sunken foundation. Post holes are then dug in the bottom of the hole to a depth of approximately five feet. Concrete is then poured into the post holes and the large hole to create a piling upon which is rested a jack. The jack is formed from an opened-top container having a thick layer of rocks or gravel in the bottom onto which concrete is poured to create a block. After the concrete has dried, a thin mixture of cement and water is pumped into the container through a side opening near its bottom to force the concrete block out of the top of the container to contact and lift the sunken foundation. This method has numerous disadvantages. First, the post holes often are not deep enough to reach stable soil. As a result, the pumping of the cement and water mixture into the container to lift the foundation forces the pilings to sink into the ground instead of lifting the foundation. Another disadvantage is that the concrete poured over the rocks or gravel to form the block can seal up the opening in the container and prevent the cement and water mixture from being pumped therein.

This invention is directed to a method and apparatus for raising and supporting a foundation that overcomes the foregoing and other problems of prior methods and devices.

SUMMARY OF THE INVENTION

In accordance with the invention, a method and apparatus for raising and supporting a foundation is provided. In accordance with the method, a hole is first excavated underneath the foundation in the area to be raised. One or more metal pipes are then driven into the earth at the bottom of the hole to form a piling. A unique concrete jack is then placed on the piling in the hole directly beneath the foundation footing. The jack is then operated by forcing a pressurized self-hardening fluid into the jack to raise the foundation.

In accordance with another aspect of the invention, a hole is first excavated underneath the foundation in the area to be raised. One or more metal pipes are then driven into the hole to form a piling. Concrete is poured into the hole and the pipes to form a pool of concrete beneath the foundation footing. A unque concrete jack is floated in the pool of concrete and aligned underneath the foundation footing. After the concrete pool has dried, the concrete jack is operated to raise the foundation.

In accordance with further aspects of this invention, reinforcing bars are placed in the hole after the step of driving pipe into the hole and prior to the step of pouring concrete to form a pool of liquid concrete.

In accordance with other aspects of this invention, the concrete jack comprises a cylinder having a closed bottom and open top, and the step of operating the concrete jack includes the step of filling the top portion of the cylinder through the opening in the top with concrete to form a vertically slidable concrete piston.

In accordance with still other aspects of this invention, the step of filling the cylinder of the concrete jack to form a slidable concrete piston further comprises the step of placing a load bearing piston base in the cylinder and supporting the base above the closed bottom of the cylinder to thereby create a space between the closed bottom and the piston base.

In accordance with still other aspects of this invention, the step of operating the concrete jack further includes pumping cement grout under pressure into the space formed between the closed bottom and the piston base to force the piston upward to threby contact and raise the footing.

As will be readily appreciated from the foregoing description, the invention overcomes the disadvantages of prior methods and devices for the raising of settled foundations. The driving of metal pipes through the unstable earth into firmer soil or bedrock provides a firm pier or piling that will prevent future settling of the foundation. In addition, the use of pipe for pilings avoids the necessity and cost of substantialy excavation around the foundation. Further, the concrete jack formed in accordance with the invention utilizes readily available materials that are relatively inexpensive. Hence, leaving the concrete jack permanently in place is not as costly as encapsulting an expensive mechanical jack or other apparaus. Another advantage to floating a concrete jack in the pool of concrete and allowing the concrete to dry is that the dried concrete reinforces the walls of the jack, thus permitting lighter and cheaper material to be used in construction of the jack.

BRIEF DESCRIPTION OF THE DRAWINGS

The foregoing and other advantages of the present invention will be better understood by reference to the following detailed description, taken in conjunction with the accompanying drawings wherein.

DESCRIPTION OF THE PREFERRED EMBODIMENT

Figure 1:
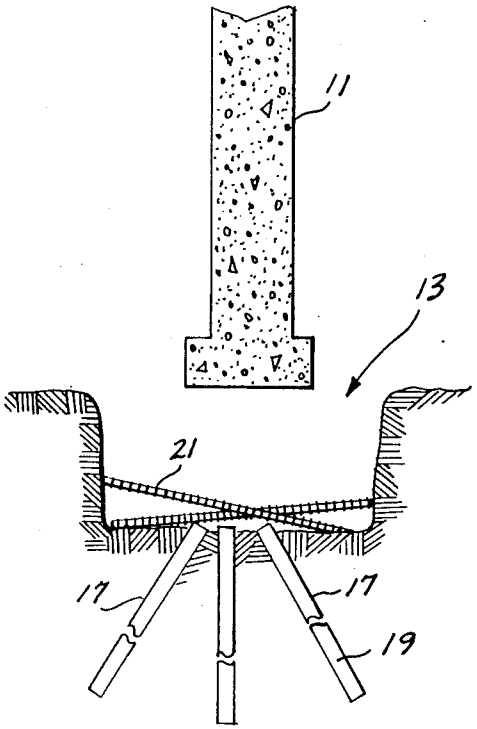
FIG. 1 is a sectioned, pictorial diagram illustrating steps of the method of the present invention including excavating a hole beneath a portion of a sunken foundation to be raised, driving pipes into the earth beneath the footing and placing rebar in the excavation.

FIG. 1 is a sectioned, pictorial diagram showing a foundation 11 that has settled below its original level. The first step in the method of the present invention is excavating a hole 13 beneath the foundation 11. Although only one hole is shown for purposes of illustration, additional sites may need to be excavated depending on the size of the foundation, the extent of the settling, and the force required to raise the foundation 11. In this regard, the size of the hole 13 needed to be excavated will depend on the size of the equipment being used to raise the foundation 11. In general, the excavated hole 13 should be large enough to receive a concrete jack formed in accordance with the present inventon and to be described hereafter. For structures on hillsides or where the foundation is otherwise inaccessible from the exterior, excavation may be done from the interior of the basement.

The second step of the method of the present invention is the driving of pipes 17 into the earth at the bottom of the hole beneath the footing 11, ideally, until bedrock or other solid ground is reached. The pipes are then cut off at the level of the bottom of the hole. Preferably, the pipes are driven into the soil at an angle such that the pipes 17 diverge away from each other to form a wider and more stable base. Hollow steel pipes of approximately 2 inch outside diameter and 1¾ inch inside diameter have been found to provide sufficient strength so that they may be driven deep into the ground and have a significant resistant to corrosion. Additionally, the hollow portion 19 may be filled with concrete to give greater rigidity as well as to provide a lasting piling should the metal pipes corrode away. A conventional jackhammer provides a suitable method for driving the pipes into the ground and a proper depth may be considered to have been reached when the jackhammer is no longer able to drive the pipes downwardly. If desired, metal reinforcing bars 21 may be laid across the bottom of the hole 13 and across the top of the pipes 17 to give greater strength to the piling.

Figure 2:
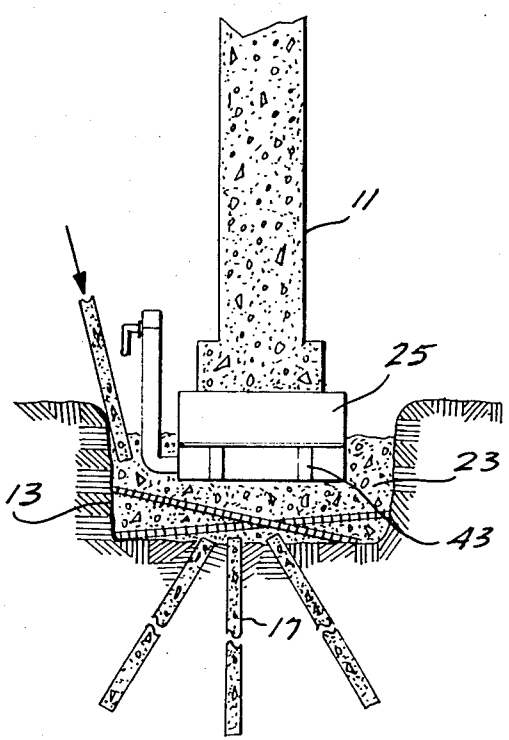
FIG. 2 is a sectioned, pictorial diagram illustrating the step of pouring concrete into the hole and the step of floating a unique concrete jack thereon.

FIG. 2 is a pictorial illustration of the step of pouring concrete 23 into the hole 13 to form a pool of liquid concrete. A unique concrete jack 25 formed in accordance with the present invention is then floated in the pool of liquid concrete and aligned beneath the footing 11. The level of the pool of liquid concrete is then raised until the concrete jack 25 urged up against the footing 11 and concrete surrounds the upper portion of the jack but does not flow into its open top. Alternatively, the jack 25 may be placed on the bottom of the hole 13 and then the liquid concrete 23 poured into the hole 13 to thereby float the jack 25 and raise it to a position abutting the footing 11. The buoyant force of the liquid concrete will hold the jack 25 in the proper position until the concrete has dried. The encasing of the jack in the hardened concrete provides reinforcement for the jack and prevents the jack walls from blowing out under high pressures. As a result, cheaper and lighter materials may be used to construct the jack.

Figure 3:
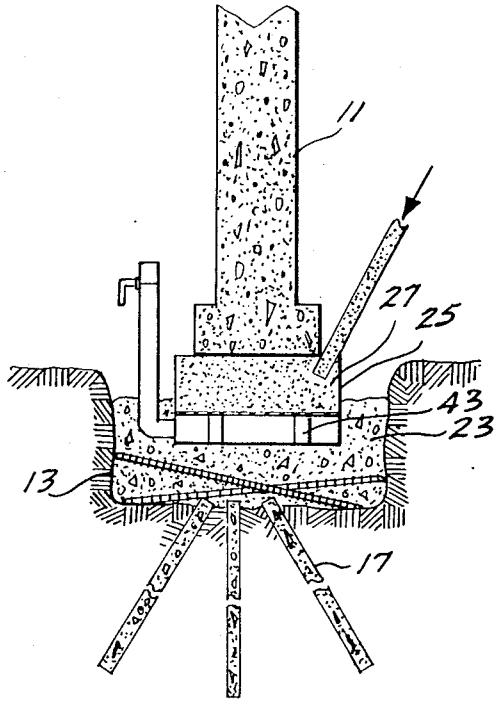
FIG. 3 is a sectioned, pictorial diagram illustrating the step of forming a concrete piston in the jack in accordance with the present invention.

As illustrated in FIG. 3, liquid concrete is then poured into the open top of the jack 25 to form a concrete plug 27. A space 45 and a piston support 41, described hereafter, will have been prepared inside the jack 25 prior to the step of floating the jack 25. The concrete is poured until it is level with the top of the jack 25.

Figure 4:
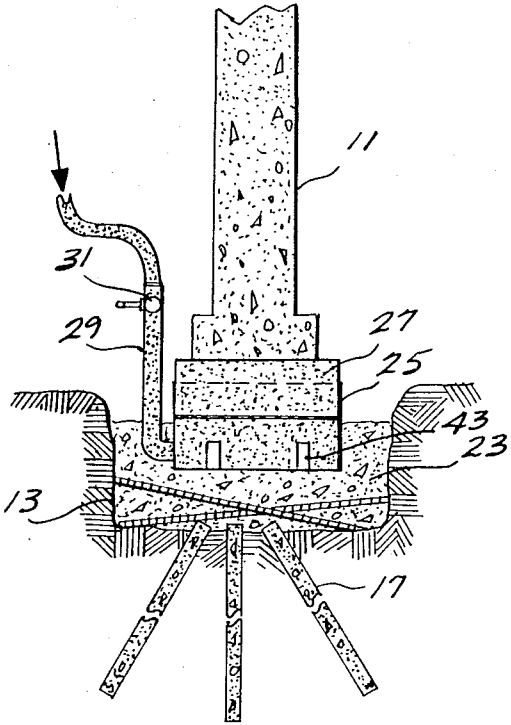
FIG. 4 is a sectioned, pictorial diagram illustrating the step of raising the piston of the concrete jack and the foundation in accordance with the present invention.

The final step of operating the jack 25 is illustrated in FIG. 4. After the concrete pool 23 and piston 27 have dried, cement grout under pressure is forced into the jack 25 through a fill pipe 29. The pressure of the cement grout forces the concrete piston 27 to rise up and thereby raise the footing 11. When the footing 11 is raised to the desired height, a valve 31 on the fill pipe 29 is closed to prevent the pressurized grout from escaping. The grout is then allowed to harden to hold the footing in its newly elevated position.

Figure 5:
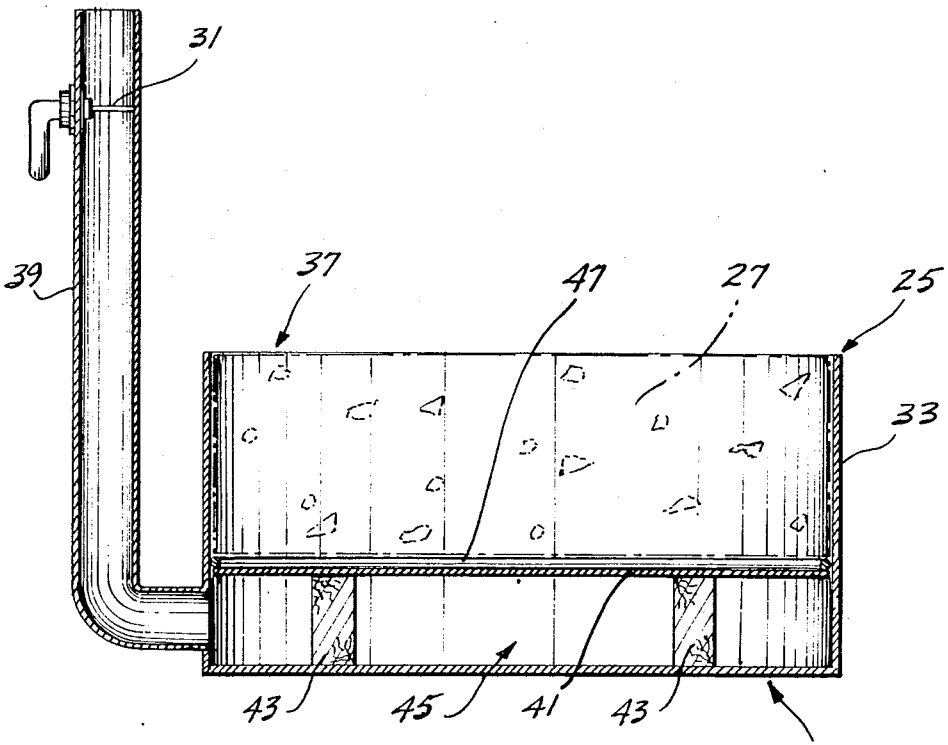
FIG. 5 is a cross-sectional view illustrating a concrete jack formed in accordance with the invention and ready for use to raise a foundation.

The construction and operation of one form of the unique jack 25 will now be described in greater detail in conjunction with FIG. 5, which is an enlarged, cross-sectional view of the jack 25. In one form, the jack is formed from a cylinder 33 having a closed bottom 35 and an open top 37. Other shapes, such as a rectangle or square, may be used. The cylinder should be constructed of a strong material to withstand the high pressures generated during lifting and, is most cases, a 55-gallon oil drum cut in half has been found to be suitable. The size of the drum will be determined by the amount of force required to lift the foundation and the amount of pressure available. Typically, a can or barrel of 23-inch diameter has been used with pressures from 100 psi to 500 psi. For a 23-inch diameter barrel at 100 psi, a total lifting force of 41,500 pounds can be exerted by the piston. For the same diameter barrel at 500 psi, a total force of 207,700 pounds could be exerted. To give stability to the jack 25, the height of the cylinder 33 should be twice as high as the amount of lift needed to raise the sunken foundation, as well as to compensate for compaction.

A fill pipe 39 is attached, preferably by welding, near the bottom of the cylinder. The pipe should be bent to angle up toward the top of the jack 25. Ideally, the open end of the pipe 39 should be threaded to accept a valve 31. The valve 31 is used to close off the fill pipe after the pressurized grout has been introduced into the jack 25. This valve 21 may be a standard water valve that can be removed after the pressurized grout has dried.

Prior to floating the jack in the liquid concrete, a space 45 is created in the bottom of the cylinder to permit later introduction of the pressurized grout. This space may be created by placing spacer blocks 43 on the bottom 35 and then resting a piston support 41 on top. These spacer blocks 43 may be rocks, wooden blocks, bricks, or other like materials. The piston support 41 may be merely a plastic sheet laid on top of the spacer blocks 43, or a thin piece of plywood or metal. Materials that could later disintegrate should be avoided to prevent eventual settling of the piston 27. In addition, in order to prevent splitting of the piston 27, rebar may be laid on top of the piston support 41 piror to the pouring of the concrete piston 27. Finally, a seal 47 may be placed around the periphery of the piston support 41 to prevent leakage of the liquid concrete into space 45 as the concrete plug 27 is hardening.

Figure 6:
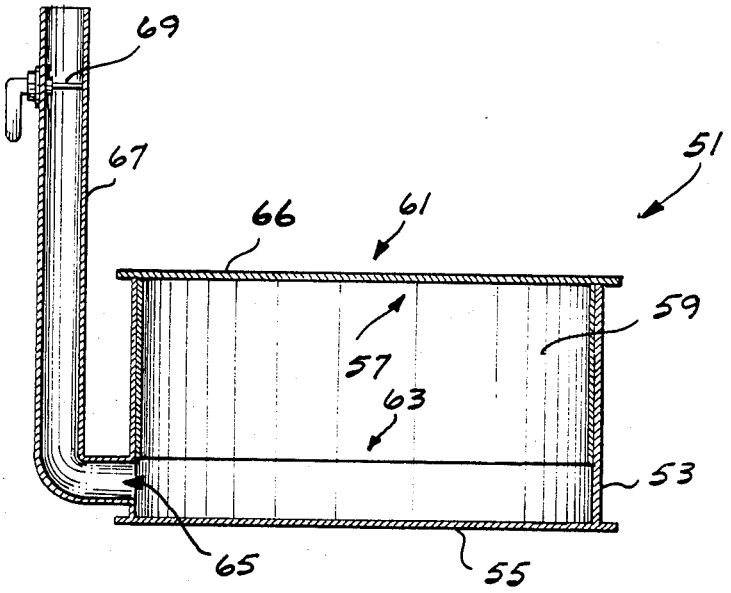
FIG. 6 is a cross-sectional view illustrating an alternative embodiment of a concrete jack formed in accordance with the present invention.
Figure 7:
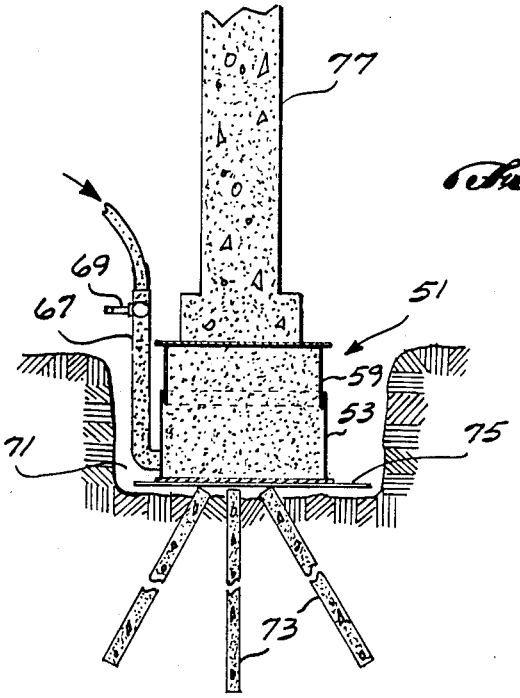
FIG. 7 is a cross-sectional view illustrating the jack of FIG. 6 in its raised position beneath a foundation.

Another form of jack 51 is shown in FIGS. 6 and 7 constructed of a first cylinder 53, having a closed bottom 55 and an open top 57, and a second cylinder 59 having a closed top 61 and an open bottom 63 slidingly engaged therewith. Preferably, the first cylinder 53 and the second cylinder 59 are constructed of relatively thick-walled pipe or tubing with the closed bottom 55 and the closed top 61 welded across one open end of each cylinder respectively. The relatively thick-walled pipe or tubing is required because the jack 51 is designed to be used without being encased in the supporting pool of concrete. Of course, the thickness of the pipe or tubing is also related to the strength of the material used, with the thickness of the pipe or tubing selected being dependent on the pressures developed and the loads encountered in raising the foundation. Ideally, the first cylinder 53 has an inside diameter that is only slightly greater than the outside diameter of the second cylinder 59 to thereby provide a tight fit when the second cylinder 59 is slidably engaged within the first cylinder 53. This tight fit will prevent the pressurized cement grout from escaping out of the jack 51 during the raising of the foundation as described hereafter.

The first cylinder 53 also has an opening 65, preferably formed in the cylinder wall near the closed bottom 55 to permit the introduction of pressurized cement grout therein. In order to prevent the walls of the second cylinder 59 from cutting off the opening 65, the closed top 61 may include a flange 66 extending therefrom to contact the open top 57 and prevent the second cylinder from descending to the bottom 55 of the first cylinder. A fill pipe 67 is welded to the opening 65 to which a high pressure hose connected to a cement pump may be attached. A valve 69 is used to close off the fill pipe 67 to prevent the pressurized cement grout from escaping the jack 51 during lifting.

FIG. 7 shows the jack 51 in operation. After the hole 71 is excavated and the pipes 73 are driven into the ground at the bottom of the hole beneath the footing at diverging angles, a metal support platform 75 may be laid in the hole 71 across the tops of the pipes 73 upon which the jack 51 is then placed. The metal support is not needed if the base 55 of the first cylinder is sufficiently strong to avoid deforming during lifting. The jack 51 is positioned directly beneath the foundation to be lifted. A source of pressurized cement grout is then attached to the fill pipe 67 and the cement grout is pumped into the jack 51. The force of the pressurized cement grout causes the second cylinder 59 to be pushed upwardly within the first cylinder 53 and thereby contact and rise the foundation 77. After the foundation is at the desired height, the valve 69 is closed to prevent the pressurized cement grout from escaping before it hardens. Use of this form of jack avoids the expense of using a concrete pool and also allows the raising of the foundation 77 to be accomplished in less time because there is no need to wait for the pool of concrete and the plug to harden prior to lifting.

As will be readily appreciated from the foregoing description, the invention provides a method and apparatus for raising and supporting a foundation that is both simple and cost effective. Concrete jacks formed in accordance with the invention may be constructed of readily available materials that make them economical. Because they may be constructed of large cylinders, they offer more surface area for raising and supporting a settled foundation and provide greater stability. As a result, fewer supporting points will be needed. In addition, because the pressure exerted by raising the foundation is spread across a greater surface area, less stress is exerted on the concrete jack.

While preferred embodiments of the invention have been illustrated and described, it will be appreciated that various changes can be made therein without departing from the spirit and scope of the invention. For instance, after the foundation has been raised, the entire concrete jack and hole may be filled to the top to encapsulate the jack and thereby provide greater support and a better appearance. Additionally, pressurized cement grout may be forced into the pipes that have been driven into the ground to thereby saturate the underlying earth and provide a more stable footing. Furthermore, other self-hardening liquids or foams may be used to operate the jack. Consequently, it is to be understood that the invention can be practiced otherwise than as specifically described herein and as set forth in the appended claims.

The embodiments of the invention in which an exclusive property or privilege is claimed are defined as follows:

1. A method of raising and supporting a settled foundation, comprising the steps of:

(a) excavating a hole beneath a portion of the foundation;

(b) driving one or more pipes into the earth at the bottom of the hole to solid ground to form a piling;

(c) placing a jack in the hole above the piling and forming a pool of selfhardening liquid in the hole and floating the jack in the pool into alignment with the foundation and allowing the liquid to harden; and (d) operating the jack by foring a self-hardening fluid into the jack to raise the foundation.

2. The method of claim 1, wherein a plurality of pipes are driven into the earth to solid ground at diverging angles to form a piling having a wide support base.

3. The method of claim 1, wherein the self-hardening fluid comprises a cement grout formed from a mixture of cement and water.

4. The method of claim 1, wherein the step of placing a jack in the hole beneath the foundation further includes the substeps of pouring concrete into the hole to form a pool of concrete, floating the jack in the pool of concrete directly beneath the foundation, and allowing the concrete to harden.

5. The method of claim 4, wherein the jack is floated into contact with the foundation to be raised and the pool of concrete is poured to a level adjacent the top of said floating jack.

6. The method of claim 1, including the step of placing reinforcing bars in the hole after said pipe has been driven into the earth and prior to pouring concrete into the hole to form a pool of concrete.

7. The method of claim 4, wherein the jack includes a cylinder having a closed bottom and an open top and wherein the step of floating the jack in the pool of concrete includes the step of filling the cylinder through the open top with concrete to form a vertically movable piston.

8. The method of claim 7, wherein the step of filling the cylinder of the jack to form a vertically movable piston includes the step of placing a piston base in said cylinder prior to filling with concrete and supporting said base above the closed bottom of said cylinder to create a space between the closed bottom and the piston base.

9. The method of claim 8, wherein the step of operating said concrete jack includes the step of pumping a self-hardening material into said space formed between the closed bottom and the piston base to force said piston upwardly to contact and raise said foundation.

10. The method of claim 9, wherein the self-hardening materials comprises a cement grout.

11. The method of claim 1, wherein the jack comprises a pair of hollow cylinders, each having a single closed end, said cylinders being slidably engaged open end to open end for vertical movement, and the step of operating said jack includes the pumping of self-hardening fluid under pressure through an opening in one of said cylinders to cause said cylinders to move vertically apart.

12. A method of raising and supporting a settled foundation comprising the steps of:

(a) excavating a hole beneath a portion of the foundation to be raised;

(b) driving at least two pipes into the earth at the bottom of the hole at diverging angles to solid ground to form a piling beneath the foundation;

(c) placing a jack having a chamber on said piling and forming a pool of selfhardening liquid in the hole to float the jack into contact with said foundation and allowing the liquid to harden;

(d) operating said jack by pumping concrete into said chamber under pressure to raise said foundation; and (e) allowing said concrete to cure before relieving said pressure thereon such that the cured concrete in said jack supports said raised foundation.

* * * * *